US008424618B2

(12) United States Patent
Harrison

(10) Patent No.: US 8,424,618 B2
(45) Date of Patent: Apr. 23, 2013

(54) AUGER BORING MACHINE

(75) Inventor: Stuart Ronald Harrison, Rye (AU)

(73) Assignee: Vermeer Manufacturing Company, Pella, IA (US)

( * ) Notice: Subject to any disclaimer, the term of this patent is extended or adjusted under 35 U.S.C. 154(b) by 667 days.

(21) Appl. No.: 12/557,304

(22) Filed: Sep. 10, 2009

(65) Prior Publication Data

US 2010/0065331 A1 Mar. 18, 2010

(30) Foreign Application Priority Data

Sep. 11, 2008 (AU) ..... 2008904747

(51) Int. Cl.
*E21B 10/44* (2006.01)

(52) U.S. Cl.
USPC ..... 175/62; 175/323; 299/68

(58) Field of Classification Search ..... 175/320, 175/220, 53, 45, 57, 62, 323; 299/56, 68
See application file for complete search history.

(56) References Cited

U.S. PATENT DOCUMENTS

| | | | | |
|---|---|---|---|---|
| 1,650,103 | A | | 11/1927 | Watchorn |
| 3,107,741 | A | * | 10/1963 | Adams et al. ..... 175/122 |
| 3,162,254 | A | | 12/1964 | Rose |
| 3,232,360 | A | | 2/1966 | Dickinson |
| 3,587,755 | A | | 6/1971 | Slusher |
| 3,612,194 | A | | 10/1971 | Richmond |
| 3,682,261 | A | | 8/1972 | Bird |
| 3,685,301 | A | | 8/1972 | Heacox |
| 3,857,449 | A | | 12/1974 | Kimura |
| 3,907,043 | A | | 9/1975 | Appleman |
| 3,910,358 | A | | 10/1975 | Martinek |
| 3,938,597 | A | | 2/1976 | Richmond et al. |
| 3,939,926 | A | | 2/1976 | Barnes et al. |
| 4,009,579 | A | | 3/1977 | Patzner |
| 4,013,134 | A | | 3/1977 | Richmond et al. |
| 4,042,046 | A | | 8/1977 | Capoccia |
| 4,047,578 | A | | 9/1977 | Appleman |
| 4,059,163 | A | | 11/1977 | Stedman |
| 4,062,196 | A | | 12/1977 | Yoshida et al. |
| 4,076,084 | A | | 2/1978 | Tighe |
| 4,226,477 | A | | 10/1980 | Capoccia |
| 4,280,732 | A | | 7/1981 | Haspert |
| 4,403,664 | A | | 9/1983 | Sullinger |
| 4,506,931 | A | | 3/1985 | Haspert |
| 4,553,612 | A | | 11/1985 | Durham |
| 4,589,502 | A | | 5/1986 | Salter et al. |
| 4,726,711 | A | | 2/1988 | Tian |
| 4,790,395 | A | | 12/1988 | Gack et al. |
| 4,877,091 | A | | 10/1989 | Howell, Jr. et al. |

(Continued)

*Primary Examiner* — Daniel P Stephenson
(74) *Attorney, Agent, or Firm* — Merchant & Gould P.C.

(57) ABSTRACT

The present disclosure relates to an auger boring machine for boring through the earth. The auger boring machine includes a cutting head for engaging a working face of the earth to cut a bore. The cutting head is rotatable about a drive axis so as to cut the earth at the working face. The auger boring machine further includes an auger that is rotatable about the drive axis for transporting spoil resulting from the operation of the cutting head away from the cutting head. Additionally, the auger boring machine includes a casing housing the auger which is urged to move into the bore behind the cutting head. The cutting head and the auger are movable along the drive axis relative to the casing. Furthermore, the auger boring machine includes a steering member positioned near the cutting head for directing movement of the casing into the bore in a steered direction transverse to the drive axis.

28 Claims, 13 Drawing Sheets

U.S. PATENT DOCUMENTS

| | | | | |
|---|---|---|---|---|
| 4,976,321 | A | 12/1990 | Van Meter | |
| 4,977,967 | A | 12/1990 | Alston et al. | |
| 5,067,570 | A | 11/1991 | Gilcrease | |
| 5,203,418 | A | 4/1993 | Gibson et al. | |
| 5,289,887 | A | 3/1994 | Püttmann | |
| 5,316,092 | A | 5/1994 | Homäki | |
| 5,361,854 | A | 11/1994 | Tull et al. | |
| 5,470,132 | A | 11/1995 | Cartwright | |
| 5,490,569 | A | 2/1996 | Brotherton | |
| 5,711,385 | A | 1/1998 | Brotherton | |
| 5,813,482 | A | 9/1998 | Barbera | |
| 5,964,306 | A | 10/1999 | Barbera | |
| 6,050,350 | A | 4/2000 | Morris et al. | |
| 6,206,109 | B1 | 3/2001 | Monier et al. | |
| 6,279,667 | B1 | 8/2001 | Culver | |
| 6,550,548 | B2 | 4/2003 | Taylor | |
| 6,607,045 | B2 | 8/2003 | Beyerl | |
| 7,134,513 | B1 | 11/2006 | Randall et al. | |
| 7,219,751 | B2 | 5/2007 | Velcover | |
| 7,334,650 | B2 | 2/2008 | Giroux et al. | |
| 7,389,831 | B2 | 6/2008 | Mullins et al. | |
| 7,770,669 | B1 * | 8/2010 | Desrochers et al. | 175/257 |
| 7,942,217 | B2 * | 5/2011 | Salins et al. | 175/334 |
| 2006/0054360 | A1 | 3/2006 | Velcover | |

* cited by examiner 40a
18
4
3
2
40
42
40b 40b
42
40
18
4
40a
2

40
18
4
40b
2
42
40a 40a
2
42
40b
18
4
40

4
3
2a
18

4
2a
18

2a
4
18

18
2a
4

4
3
2b
18

4
2b
18

4
2b
18

2b
18
4

AUGER BORING MACHINE

This application claims benefit of Ser. No. 2008904747, filed Sep. 11, 2008, in Australia and which application is incorporated herein by reference. To the extent appropriate, a claim of priority is made to the above disclosed application.

TECHNICAL FIELD

This disclosure relates to an auger boring machine for use in underground boring. The devices disclosed herein have a particular application in boring horizontal, longitudinally extending bores, and it will be convenient to hereinafter describe the devices with reference to this application. It is to be appreciated however that the devices disclosed in this disclosure may have other applications, including but not limited to boring vertical shafts.

BACKGROUND

The following discussion of machines is included in this specification solely for the purpose of providing a context for the present disclosure. It is not suggested that any of these matters formed part of the prior art base or were common general knowledge in the field relevant to the present disclosure.

An auger boring machine is a type of boring machine that uses a rotatable cutting head to cut the earth, and a driven auger to transport the spoil away from the cutting head. A casing is used to retain the integrity of the bore and to allow the spoil to be transported along the bore. The casing may also be left in place after the bore is complete to provide a conduit for services to pass there through. An auger boring machine is often used where services need to be laid underground and it is not convenient to dig a trench, such as when passing under a roadway or rail line.

The casing and auger have a tolerance that allows the auger to rotate within the casing, provided the auger and casing are substantially aligned with the selected direction. The casing can be diverted from its selected direction by variations in friction of the outside wall of the casing and the surrounding earth. Alternatively the casing can be diverted by tree roots or floaters.

Failure to maintain the auger and casing substantially aligned with the selected direction can result in the auger rubbing on the inside wall of the casing. This creates friction between the auger and the casing and causes the drive motor to work harder. Excessive misalignment can result in damage or failure of the boring machine.

The inventor is aware of an auger boring machine that has a short casing piece at the front of the main casing, which can pivot relative to the main casing to provide the machine with steering capabilities. A ram is provided external to the main casing which is operable to pivot the short casing piece. This arrangement only allows for steering in one plane. Furthermore, the ram being external to the casing adversely imparts on movement of the casing through the bore and, is susceptible to damage as the casing is moved along the bore.

Obstructions such as a tree root or more critically a floater often block the selected path of the bore. Where this occurs the obstruction needs to be ground up so that it can pass through the cutting head, or between the cutting head and the casing, into the flight of the auger. This is time consuming and can result in dulling of the cutting head.

It would therefore be desirable to provide an auger boring machine that addressed at least one of these problems. It is preferred that the machine be capable of providing a useful alternative to overcoming obstructions in the path of the selected direction. It is also preferred that the machine be configured to substantially maintain alignment with the selected direction.

SUMMARY

According to this disclosure, there is provided an auger boring machine for boring through earth. The boring machine includes a cutting head locatable in use so as to engage a working face of the earth. The cutting head is rotatable about a drive axis so as to cut the earth at the working face. The boring machine also includes an auger that is rotatable about the drive axis for transporting spoil resulting from the operation of the cutting head away from the cutting head, and a casing housing the auger which is urged to move into the bore behind the cutting head. The cutting head is movable in the axial direction relative to the casing.

It is preferred that the auger boring machine include a steering shoe located near the cutting head for directing the movement of the casing into the bore in a steered direction transverse to the axial direction. It is further preferred that the steering shoe is rotated about the drive axis relative to the casing for adjusting the steered direction. It is further preferred that the steering shoe is rotated in conjunction with rotation of the cutting head to adjust the steered direction. It is further preferred that the cutting head is retracted in the axial direction to engage directly or indirectly the steering shoe and is rotated to rotate the steering shoe. It is further preferred that the cutting head is rotatable in a clockwise or an anticlockwise direction to rotate the steering shoe accordingly. It is further preferred that the cutting head is configured to positively engage the steering shoe so that rotation of the cutting head causes direct rotation of the steering shoe. It is further preferred that the cutting head and steering shoe include one or more teeth which interact to positively engage. It is further preferred that the steering shoe includes a steering sleeve having an eccentric configuration relative to the drive axis of the cutting head.

In one embodiment, the steering sleeve can include an inner surface that is concentric with the drive axis and an outer surface that is eccentric with respect to the drive axis. The outer surface can include a first portion that is positioned further radially outwardly from the drive axis than a second portion of the outer surface. In use of the auger boring machine, the first portion of the steering sleeve is spaced from the drive axis in an opposite direction to the intended steer direction. By turning the steering sleeve about the drive axis, the position of the first portion of the outer surface can be circumferentially adjusted to steer the auger boring machine. In another embodiment, the steering sleeve can be rotatably mounted within the casing and can include an outer surface that is concentric with inner and outer surfaces of the casing and is eccentric with respect to the drive axis. The steering sleeve also includes an inner surface that is concentric with the auger and the drive axis. The inner surface can be configured to contact the auger at a location adjacent the cutting head. By rotating the steering sleeve within the casing, the circumferential orientation of the outer surface can be adjusted relative to the auger. Circumferential adjustment of the steering sleeve causes radial movement of the auger relative to the casing which provides steering of the auger boring machine through radial movement of the cutting head relative to the casing.

It is preferred that the auger boring machine include thrust means for moving the cutting head and the auger axially relative to the casing. In one embodiment, the thrust means moves the cutting head and the auger axially relative to the casing by no more than one flight length of the auger. In other embodiments, the thrust means is capable of moving the cutting head and the auger along the drive axis relative to the casing an axial distance equal to at least one flight length of the auger. In still other embodiments, the thrust means is capable of moving the cutting head and the auger along the drive axis relative to the casing an axial distance equal to at least three-quarters of one flight length of the auger.

It is preferred that the auger boring machine include a rotational drive means for rotating the cutting head and auger, the rotational drive means being movable in the axial direction by operation of the thrust means so as to move the cutting head relative to the casing. It is further preferred that the rotational drive means is located on a movable frame and associated with thrust means for moving the rotational drive means in the axial direction. It is further preferred that the thrust means is operative to urge the casing into the bore. It is further preferred that the thrust means engages directly or indirectly a thrust bridge which is movable with the casing into the bore, the casing being fixed to the thrust bridge so as to resist rotation relative to the bore. It is further preferred that the thrust bridge is located on a movable frame that is movable independently of movement of the cutting head.

It is further preferred that the thrust means include any one of a ram, scissor drive, rack and pinion or screw drive.

It will be convenient to hereinafter describe in greater detail preferred embodiments of the auger boring machine according to the disclosure, with reference to the accompanying drawings. The particularity of the drawings and the related detailed description is not to be understood as superseding the generality of the preceding broad definition of the invention.

DETAILED DESCRIPTION

Figure 1:
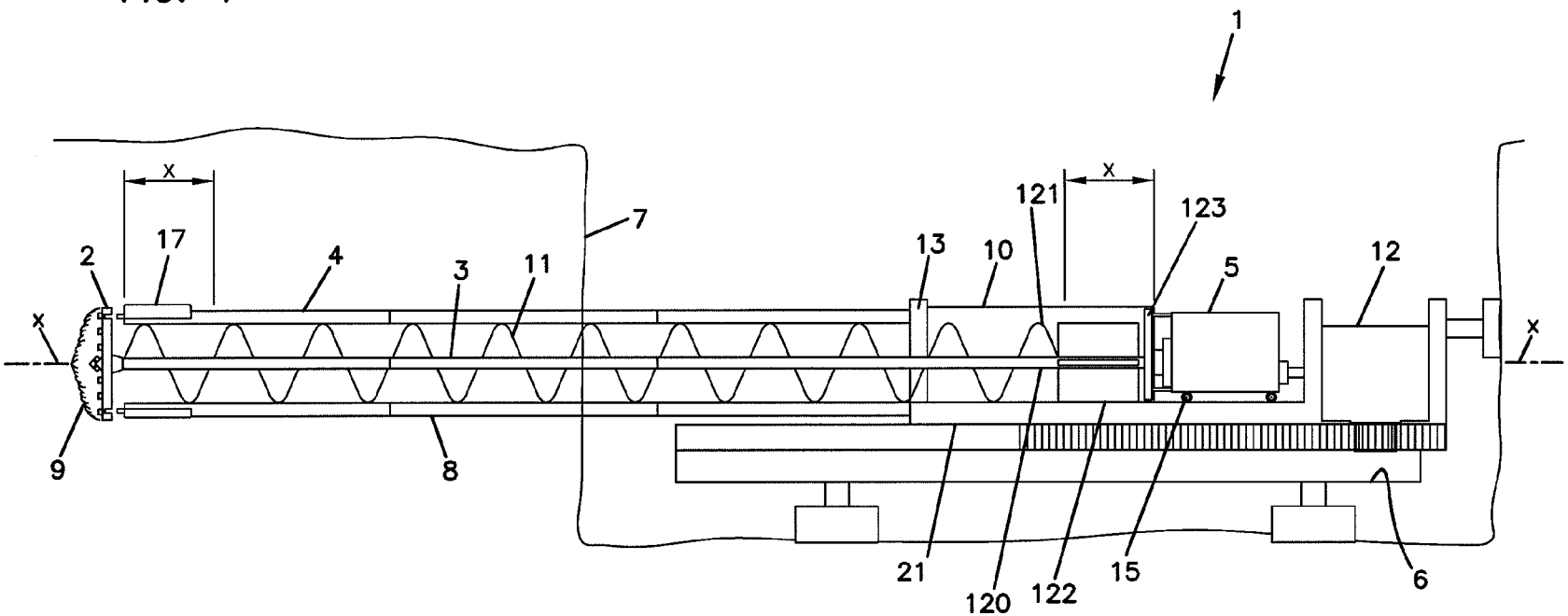
FIG. 1 is a schematic side elevation and partial cross-sectional view of a preferred embodiment of the auger boring machine with the cutting head in a normal operating position.

Referring to FIG. 1 which illustrates an auger boring machine 1 including, in summary, a cutting head 2, an auger 3, a casing 4 and rotational drive means 5. When in use the rotational drive means 5 will be located in a pit 6 adjacent the earth 7 being cut by the cutting head 2, whilst the cutting head 2, auger 3 and casing 4 will be located within the bore 8.

The cutting head 2 is located at a distal end of the auger 3 remote from the drive means 5. The drive means 5 is located adjacent a proximal end of the auger 3. The cutting head 2 is rotated about a drive axis X-X by the drive means 5 and engages a working face 9 of the earth 7 so as to reduce the earth 7 to particulate material often referred to as spoil. The type and configuration of the cutting head 2 may vary according to the conditions within which the machine 1 is operating, in a manner that will be understood by those skilled in the industry. More specifically, the invention is not limited to any one particular style, shape, configuration of cutting head 2. The rotational drive means 5 can be powered by any number of different configurations. Example configurations include a hydraulic drive or a direct or indirect power take-off from an engine.

The auger 3 extends between the cutting head 2 and the rotational drive means 5 and is rotatable about the drive axis X-X in conjunction with the cutting head 2 so as to transport spoil in a distal to proximal direction from the cutting head 2 to an extraction tub 10 located between the auger 3 and the rotational drive means 5. Augers 3 with a different flight characteristic of amplitude and wavelength may be selected depending upon the conditions in which the machine 1 is operating.

Figure 1A:
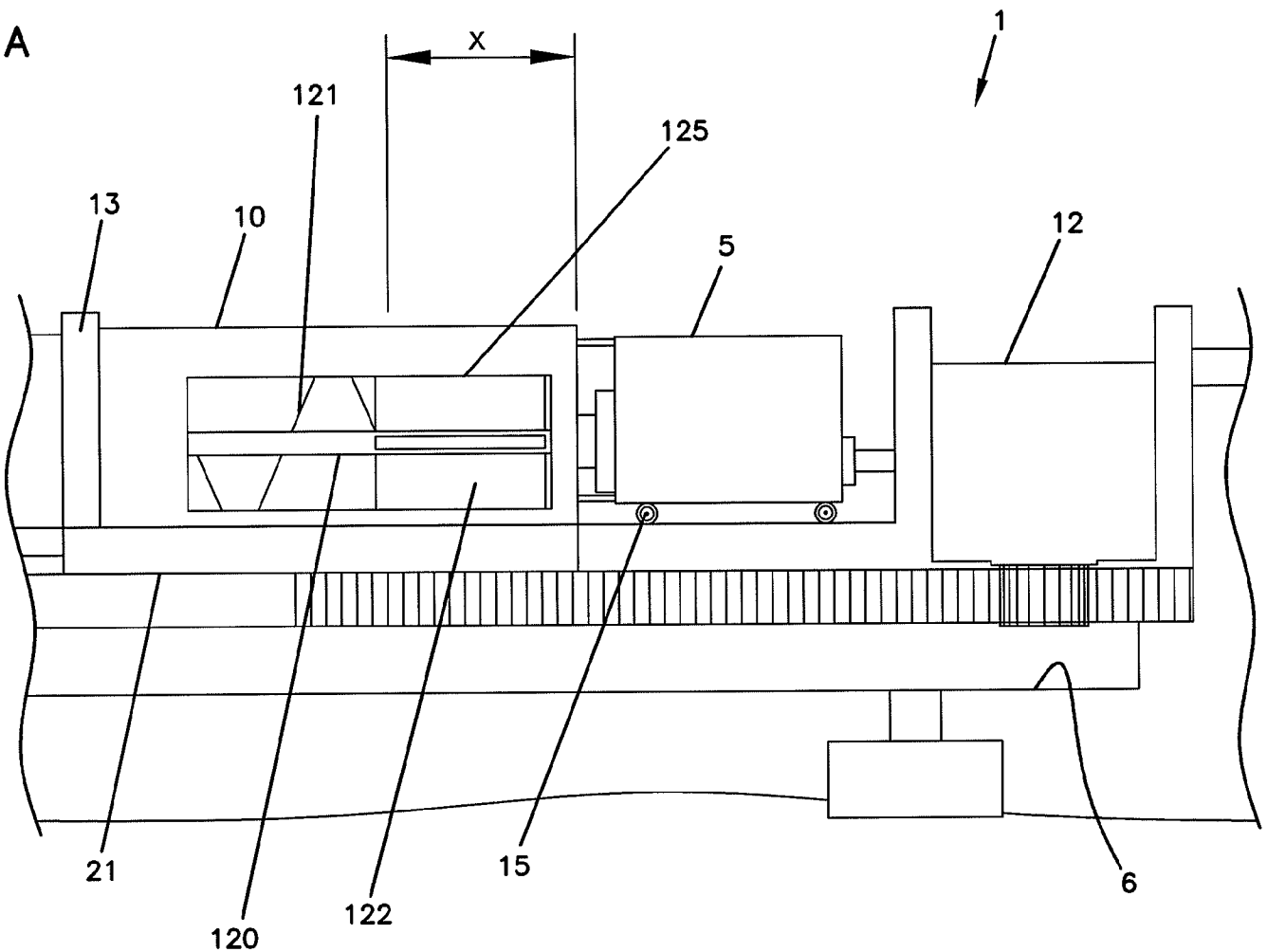
FIG. 1A is schematic side view of a portion of the auger boring machine of FIG. 1 with a side wall of the extraction tub visible.

Torque for rotating the auger 3 is transferred from the rotational drive means 5 to the auger 3 by a drive stem extension 120. A proximal end of the drive stem extension 120 couples to the rotational drive means 5 and a distal end of the drive stem extension 120 is coupled to the proximal end of the auger 3. The drive stem extension 120 is aligned along the axis X-X and extends through the extraction tub 10. The extraction tub 10 provides a location for spoil to exit from the bore. An auger section 121 is secured along a distal portion of the drive stem extension 120. The auger section 121 conveys spoil received from the auger 3 proximally through the extraction tub 10 when the drive stem extension 120 is rotated in a first direction about the axis X-X. An extraction paddle structure 122 is secured along a proximal portion of the drive stem extension 120. The extraction paddle structure 122 is rotated about the axis X-X by the drive stem extension 120 and functions to force spoil material received from the auger section 121 laterally out of the extraction tub 10 through a side discharge opening 125 (see FIG. 1A) of the extraction tub 10. A blocking plate 123 is mounted to an outer housing of the rotational drive means 5. The blocking plate 123 is positioned adjacent to the extraction paddle structure 122 and fits closely within the extraction tub 10 prevent spoil from passing through the proximal end of the extraction tub 10. The blocking plate 123 does not rotate with the drive stem extension 120. A conveyor system (not shown) may be included to receive the spoil from the side discharge port 125 of the extraction tub 10 and to move the spoil out of the pit 6 to a more convenient location. Other appropriate means for removing the spoil from the extraction tub will be understood by those skilled in the industry.

The auger 3 is located within the casing 4 with sufficient tolerance to allow the auger 3 to rotate relative to the casing 4 by way of operation of the rotational drive means 5 via the drive stem extension 120. The casing 4 provides support for the bore 8 and provides a conduit through which the spoil can be extracted by the auger 3. The casing 4 is often sacrificial, in that it is left within the bore 8 after the bore has been cut.

The casing 4 is urged into the bore 8 by a thrust means 12 which applies a force to a thrust frame 21 including a thrust bridge 13 engaging the casing 4. It is generally preferable for the thrust bridge 13 to be connected to the casing 4 (e.g., via latches, connection pins, connection clips, interlocking teeth or other structures) so as to reduce the likelihood of the casing 4 rotating with the auger 3. However, other forms of connection are also possible. For short runs where only a single casing section is needed, the casing may be welded to the thrust bridge 13.

Where the bore 8 exceeds the length of the casing 4, it will be necessary to introduce a further section of casing 4 and section of auger 3 to the bore 8 (e.g., a string of 3 casing and auger sections are shown interconnected at FIG. 1). The casing 4 is often provided in 6 m length with sections of auger 3 of equivalent length. Where this is required, the thrust bridge 13 will be disconnected from the proximal-most casing section 4 and the distal end of the drive stem extension 120 will be disconnected from the proximal-most auger section. The thrust frame 21 will then be retracted by the thrust means 12 so as retract the thrust bridge 13 and the rotational drive means 5 relative to the proximal-most casing and auger sections. Retraction of the thrust frame provides clearance for allowing a subsequent section of casing 4 to be connected to the proximal-most casing section 4 and also for allowing a subsequent auger section to be coupled between the proximal-most auger section and the distal end of the drive stem extension 120. Thereafter the thrust means 12 will again be able to urge the interconnected casing sections 4 as well as the interconnected auger sections into the bore 8 behind the cutting head 2.

The individual auger sections are preferably connected by interconnections that allow torque for rotating the auger sections and the cutting head 2 relative to the casings to be transferred from auger section to auger section. Also, the interconnection between the auger sections preferably allows thrust and pull-back load to be transferred axially through the auger sections so as to allow the auger sections and the cutting head to be axially extended and retracted relative to the casing sections. In one embodiment, the auger sections are interconnected by male ends (e.g., hexagonal ends) that fit within female sockets (e.g., hexagonal sockets) to allow torque to be transferred from auger section to auger section. Pins can be used at the mating ends to allow pull-back load to be transferred from auger section to auger section. In certain embodiments, the casing sections can also be connected by interconnections that allow thrust and pull-back load to be directed through the string of casing sections.

Figure 2:
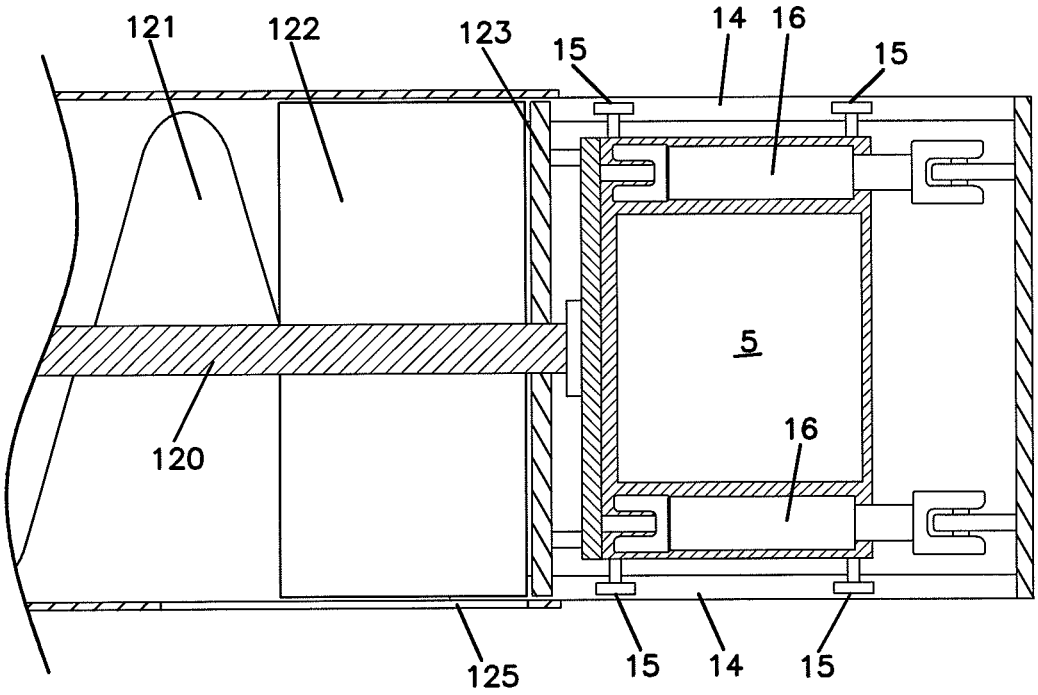
FIG. 2 is a schematic top plan and partial cross-sectional view of the drive means, extraction tub and thrust bridge when the cutting head is in the normal operating position.
Figure 4:
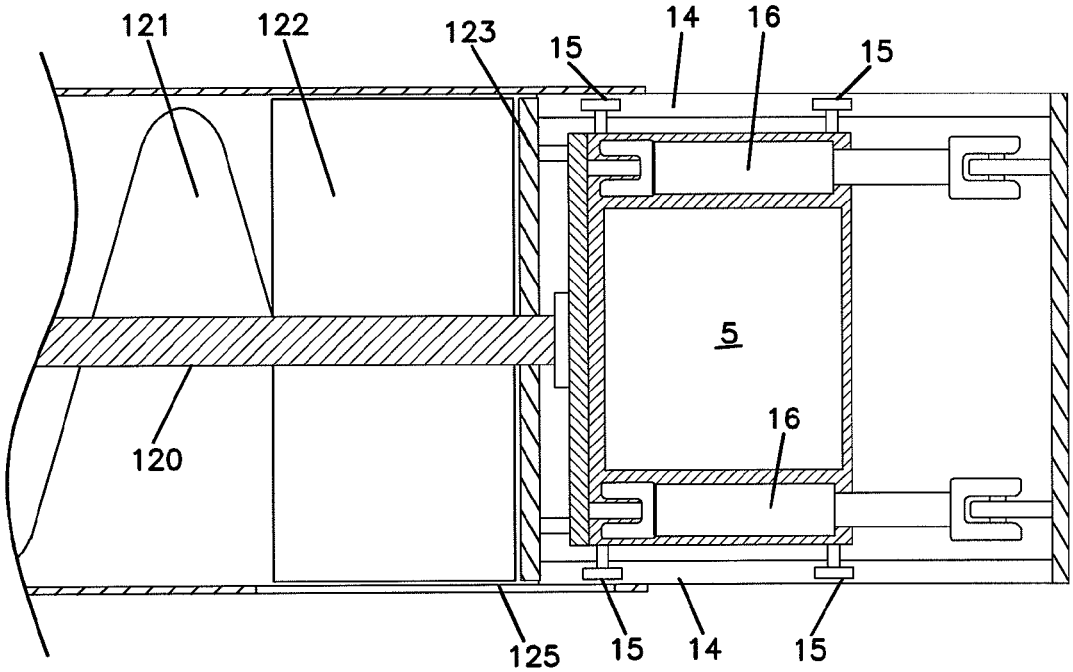
FIG. 4 is a schematic top plan and partial cross-sectional view of the drive means, extraction tub and thrust bridge when the cutting head is in the extended operating position.

The cutting head 2 of the boring machine 1 is movable relative to the casing 4. This may be achieved in any suitable manner however in the embodiment illustrated the rotational drive means 5 is movable relative to the casing 4 and the thrust frame 21 so as to move the auger 3 and the cutting head 2 therewith. The rotational drive means 5 illustrated in FIGS. 2 and 4 is located on a set of tracks 14 with wheels 15 to facilitate movement of the rotational drive means 5 relative to the tracks 14. Additional thrust means 16 are illustrated for moving the drive means 5 along the tracks 14 relative to the bridge 13 and the casing 4.

Whilst the illustrations show a rack and pinion drive 12 for thrusting the thrust bridge 13, and a hydraulic ram 16 for thrusting the rotational drive means 5, other forms of thrust means are clearly possible. Other forms of thrust means may include, but are not limited to, screw drives, and scissor rams.

Figure 3:
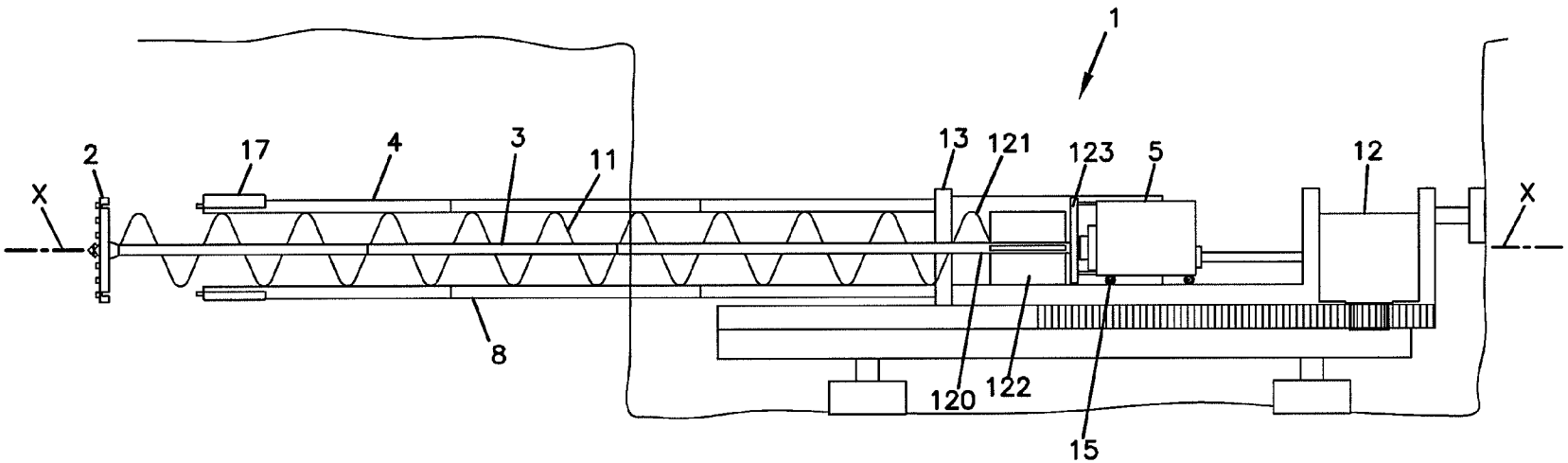
FIG. 3 is a schematic side elevation and partial cross-sectional view the auger boring machine with the cutting head in an extended operating position.

FIG. 1 shows the rotational drive means 5 in a retracted position spaced proximally from the extraction tub 10. FIG. 3 illustrates the drive means 5 in an extended position spaced distally from the retracted position. When in the extended position, the drive means 5 is positioned at least partially within the extraction tub 10.

Movement of the drive means 5 from the retracted position to the extended position moves drill stem extension 120 and the auger 3 distally relative to the casing 4 thereby causing the cutting head 2 to move distally away from a distal end of the casing 4. Distal movement of the drill stem extension 120 causes the auger section 121 to slide into the proximal end of the proximal-most casing 4 and the paddle structure 122 to move distally within the extraction tub 10. The discharge opening 125 of the extraction tub 10 is elongated so as to coincide with the range of proximal to distal movement of the paddle structure 122. Movement of the cutting head 2 relative to the casing 4 allows the machine 1 to better accommodate roots or floaters (e.g., obstructions "floating" in the soil such as rocks or debris) within the flight 11 of the auger 3. In one embodiment, the cutting head 2 can be moved distally out by no more than one flight length x of the auger 3 beyond the distal end of the casing 4. In other embodiments, the thrust means 16 is capable of moving the cutting head 2 and the auger 3 along the drive axis X-X relative to the casing 4 an axial distance equal to at least one flight length x of the auger 3. In still other embodiments, the thrust means 16 is capable of moving the cutting head 2 and the auger 3 along the drive axis X-X relative to the casing 4 an axial distance equal to at least three-quarters of one flight length x of the auger 3. As used herein, the term "flight length" means the axial length required for the flight 11 of the auger 3 to turn 360 degrees about the auger shaft.

The casing 4 will adopt a steered direction depending upon the way it interacts with the earth adjacent the distal end of the casing 4. It is preferred that the steered direction be adjustable so that the casing 4 be capable of being steered to maintain alignment with a selected direction. This may be achieved in any suitable manner however in the embodiment illustrated the boring machine 1 includes a steering shoe 17 located at the distal end of the casing 4 adjacent the cutting head 2. The steering shoe 17 in the embodiment illustrated in FIG. 5 may take the form of a shell/sleeve 18 which fits over a distal portion 19 of the casing 4. The sleeve 18 has a generally circular external surface with the centre of that circle spaced transversely to the drive axis X-X. Thus, an outer surface 40 of the sleeve 18 is eccentric with respect to the drive axis X-X and an inner surface 42 of the sleeve 18 is concentric with respect to the drive axis X-X. The inner surface 42 rotates about an outer surface of the casing and a bushing/bearing can be provided between the sleeve 18 and the casing to facilitate rotation of the sleeve 18 relative to the casing 4. The centre of the outer circle is spaced from the drive axis in an opposite direction to the selected steered direction.

Figure 5:
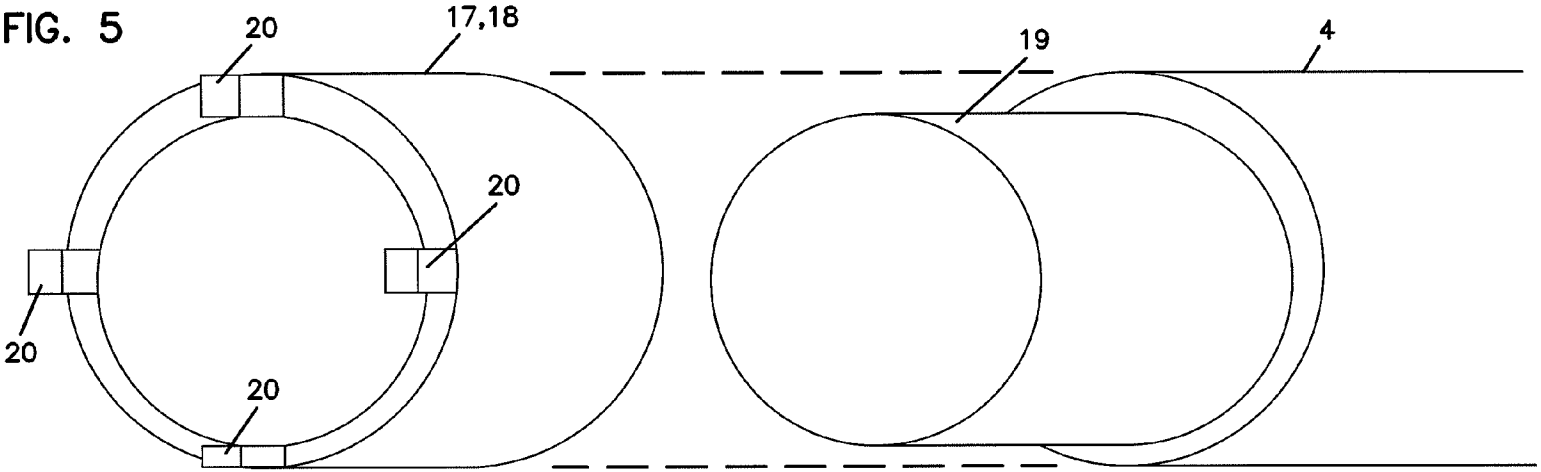
FIG. 5 illustrates an isometric view of a preferred embodiment of the steering shoe and casing configuration.

In order to adjust the position of the centre of the outer circle of the sleeve 18, the cutting head 2 is capable of being retracted so as to engage the steering shoe 17. It is preferred that the cutting head 2 and steering shoe 17 include one or more teeth 20 so as to allow the cutting head 2 and steering shoe 17 to positively engage. FIG. 5 shows the shoe with four teeth however this number is merely preferred. The size and shape of the depicted teeth are schematic. These teeth engage complementary features on the backside of the cutting head 2 (not shown), so as to provide positive engagement of the cutting head 2 with the steering shoe 17. Other forms of positive engagement are clearly possible.

Figure 6:
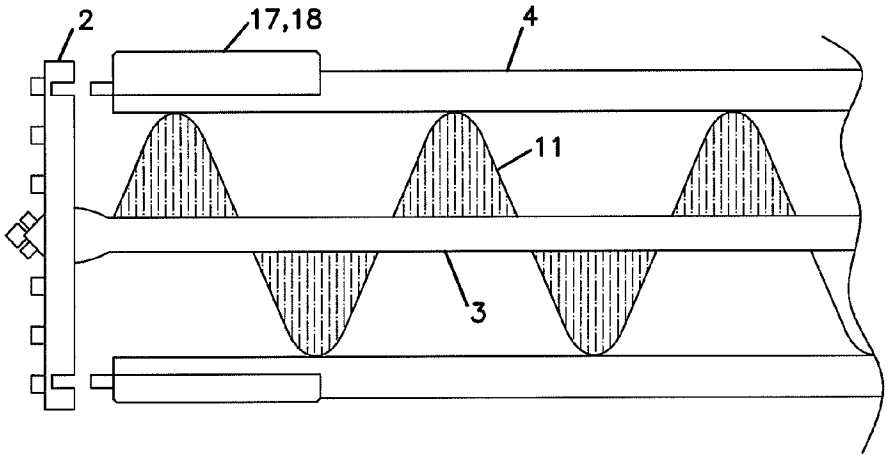
FIG. 6 illustrates a schematic side elevation and partial cross-sectional view of the cutting head, steering shoe and portion of casing with the cutting head in a normal operating position relative to the casing.
Figure 7:
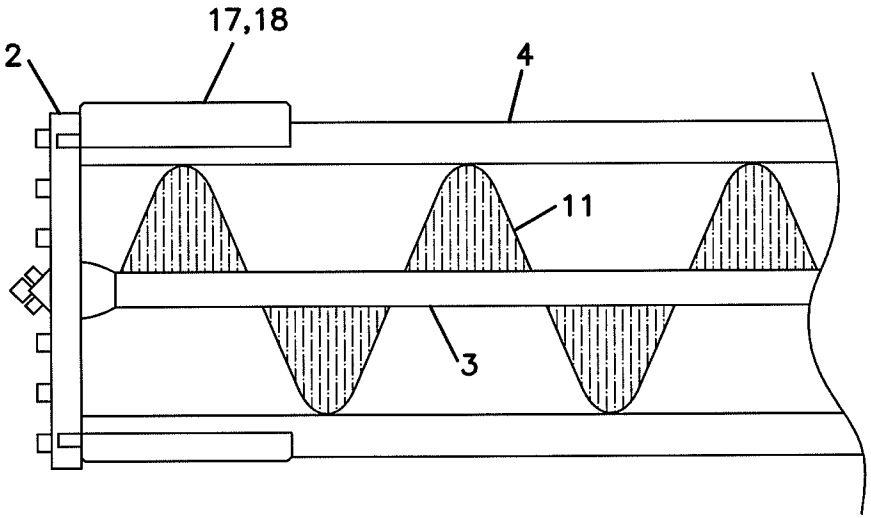
FIG. 7 illustrates a schematic side elevation and partial cross-sectional view of the casing, steering shoe and cutting head with the cutting head retracted to engage the steering shoe.
Figures 8A, 8B, 8C, 8D, 9A, 9B, 9C, 9D, 10A, 10B, 10C, 10D:
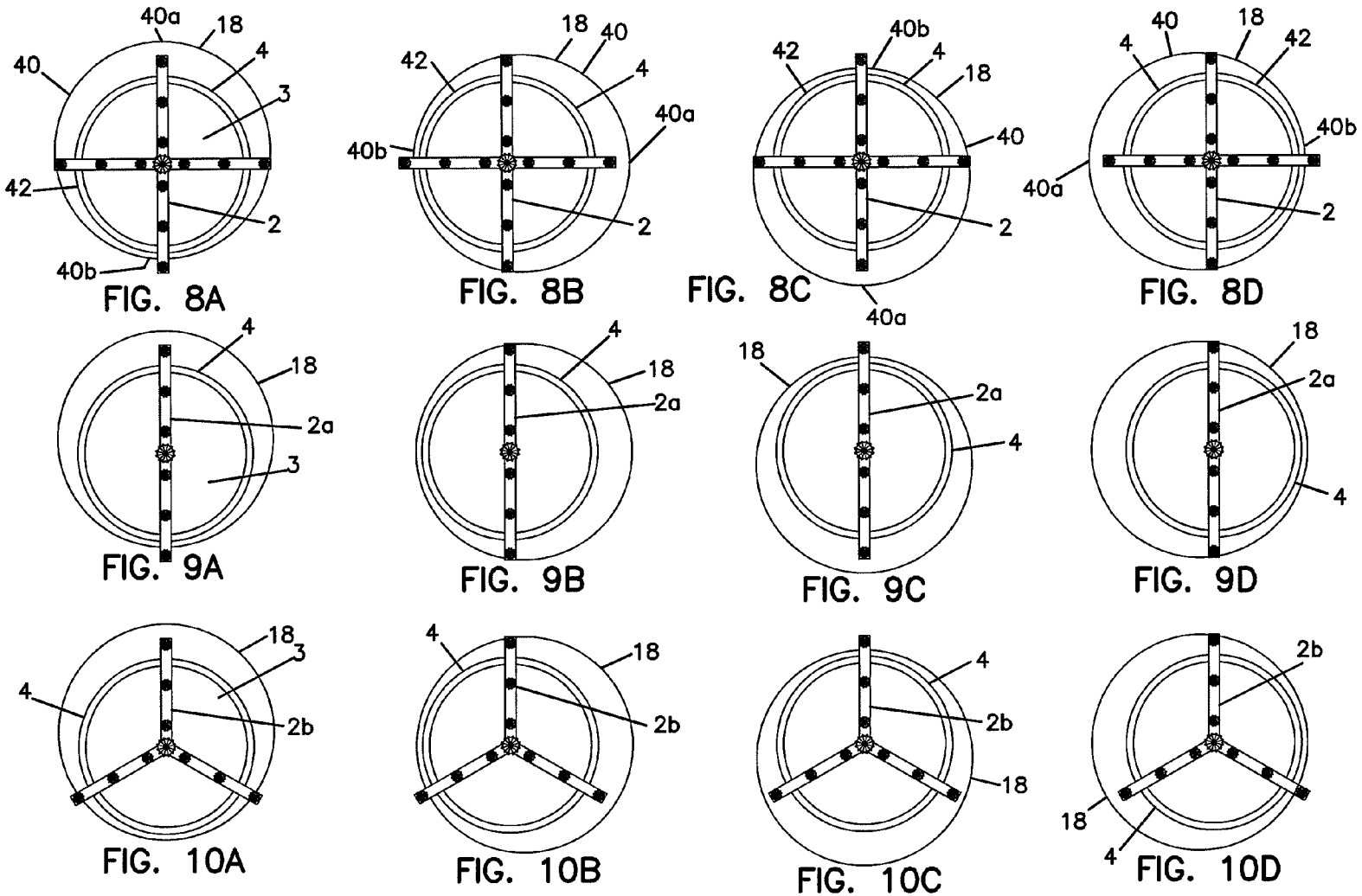
FIG. 8A is a front elevation view showing the steering shoe in a first circumferential position relative to the casing and a 4-bar cutting head, the first circumferential position is adapted to direct the cutting head in a downward direction.
FIG. 8B is a front elevation view showing the steering shoe in a second circumferential position relative to the casing and the 4-bar cutting head, the second circumferential position is adapted to direct the cutting head in a rightward direction.
FIG. 8C is a front elevation view showing the steering shoe in a third circumferential position relative to the casing and the 4-bar cutting head, the third circumferential position is adapted to direct the cutting head in an upward direction.
FIG. 8D is a front elevation view showing the steering shoe in a fourth circumferential position relative to the casing and the 4-bar cutting head, the fourth circumferential position is adapted to direct the cutting head in a leftward direction.
FIG. 9A is a front elevation view showing the steering shoe in a first circumferential position relative to the casing and a 2-bar cutting head, the first circumferential position is adapted to direct the cutting head in a downward direction.
FIG. 9B is a front elevation view showing the steering shoe in a second circumferential position relative to the casing and the 2-bar cutting head, the second circumferential position is adapted to direct the cutting head in a rightward direction.
FIG. 9C is a front elevation view showing the steering shoe in a third circumferential position relative to the casing and the 2-bar cutting head, the third circumferential position is adapted to direct the cutting head in an upward direction.
FIG. 9D is a front elevation view showing the steering shoe in a fourth circumferential position relative to the casing and the 2-bar cutting head, the fourth circumferential position is adapted to direct the cutting head in a leftward direction.
FIG. 10A is a front elevation view showing the steering shoe in a first circumferential position relative to the casing and a 3-bar cutting head, the first circumferential position is adapted to direct the cutting head in a downward direction.
FIG. 10B is a front elevation view showing the steering shoe in a second circumferential position relative to the casing and the 3-bar cutting head, the second circumferential position is adapted to direct the cutting head in a rightward direction.
FIG. 10C is a front elevation view showing the steering shoe in a third circumferential position relative to the casing and the 3-bar cutting head, the third circumferential position is adapted to direct the cutting head in an upward direction.
FIG. 10D is a front elevation view showing the steering shoe in a fourth circumferential position relative to the casing and the 3-bar cutting head, the fourth circumferential position is adapted to direct the cutting head in a leftward direction.
Figure 11B:
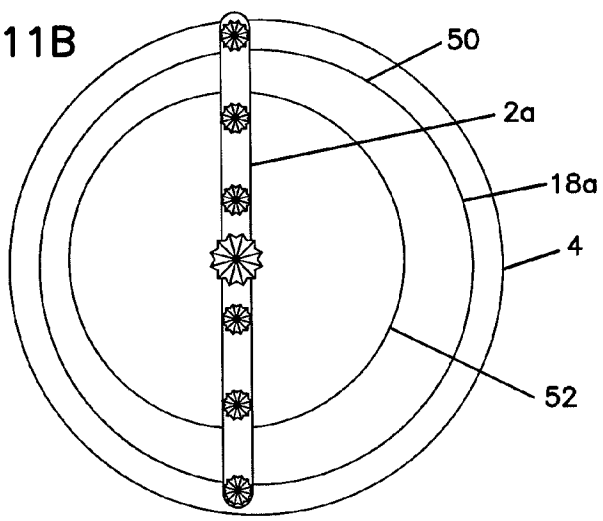
FIG. 11B is a front elevation view showing the modified steering shoe in a second circumferential position inside the casing, the second circumferential position is adapted to offset the cutting head in a rightward direction relative to the casing.
Figure 11D:
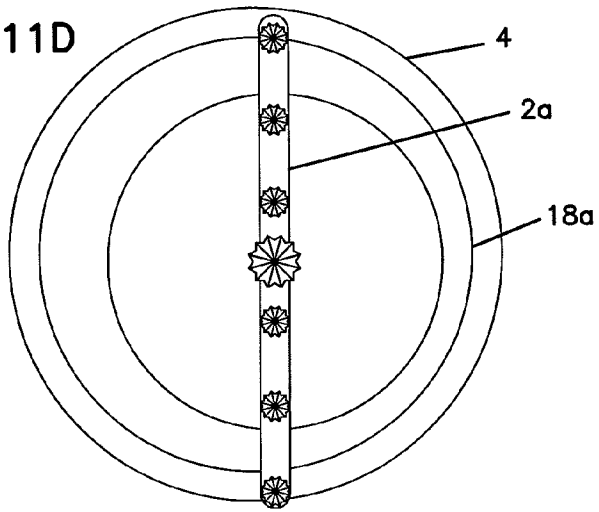
FIG. 11D is a front elevation view showing a modified steering shoe in a fourth circumferential position inside the casing, the fourth circumferential position is adapted to offset the cutting head in a leftward direction relative to the casing.
Figure 11A:
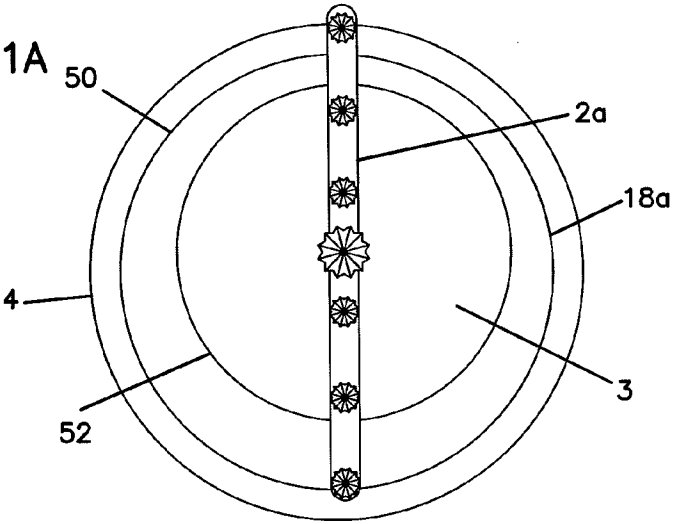
FIG. 11A is a front elevation view showing a modified steering shoe in a first circumferential position inside the casing, the first circumferential position is adapted to offset the cutting head in an upward direction relative to the casing.
Figure 11C:
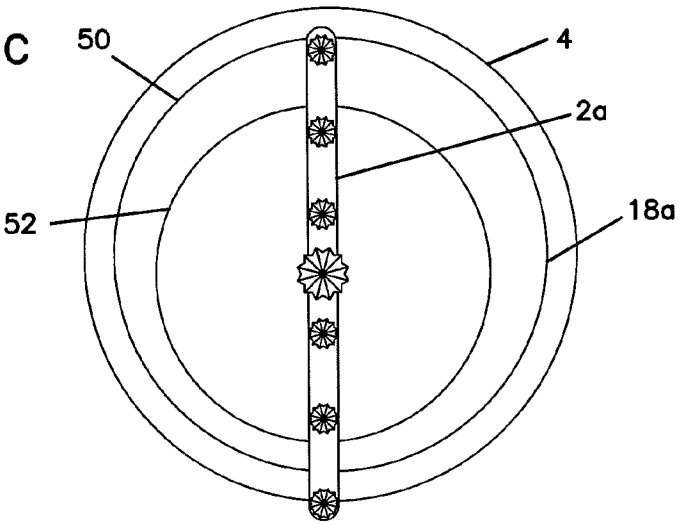
FIG. 11C is a front elevation view showing the modified steering shoe in a third circumferential position inside the casing, the third circumferential position is adapted to offset the cutting head in a downward direction relative to the casing.

FIG. 6 illustrates the cutting head in a normal operating position relative to the casing similar to that shown in FIG. 1. FIG. 7 illustrates the cutting head 2 engaging the steering shoe 17. Once the cutting head 2 has engaged the steering shoe 17, the cutting head 2 can be rotated relative to the casing 4, clockwise or anticlockwise, so as to rotate the steering shoe 17 relative to the casing 4 about the axis X-X. It ought to be appreciated from FIGS. 8A to 8D that circumferentially adjusting the steering shoe 17 in this way allows for adjustment of the steered direction of the casing 4 down, up, right or left.

Because the centre of the outer circle of the steering sleeve 18 is offset from the axis X-X, the outer surface 40 of the steering sleeve 18 has a first portion 40*a* spaced a maximum radial distance from the axis X-X and opposite second portion 40*b* spaced a minimum radial distance from the axis X-X. During drilling operations in which the cutting head 2 is rotated about the axis X-X relative to the steering shell 18, the distal end of the drill string will be urged to move in a direction opposite from the position of the first portion 40*a* (e.g., if the first portion 40*a* is up, the distal end of the drill string will be urged downwardly during drilling). Thus, by selectively adjusting the circumferential/rotational position of the first portion 40*a* about the axis X-X, the steered direction can be changed. For certain embodiments, drilling can take place while the cutting head 2 is engaged with the steering shoe 17 during drilling. This results in the steering shoe 17 being continuously rotated with the cutting head 2 during drilling such that a straight bore is drilled.

FIGS. 9A-9D show the distal end of the auger boring machine 1 equipped with a two-bar cutting head 2*a*. FIGS. 9A-9D show the steering shell 18 in 4 different steering positions relative to the cutting head 2*a*. FIGS. 10A-10D show the distal end of the auger boring machine 1 equipped with a three-bar cutting head 2*b*. FIGS. 10A-10D show the steering shell 18 in 4 different steering positions relative to the cutting head 2*b*.

FIGS. 11A-11D show the distal end of the auger boring machine 1 equipped with a modified steering shell 18*a* and the two-bar cutter 2*a*. The steering shell 18*a* is rotatably mounted within the casing 4 at the distal end of the casing 4. The steering shell 18*a* includes an outer surface 50 that is concentric with inner and outer surfaces of the casing and that is eccentric with respect to the axis X-X and the auger 3. The steering shell 18*a* includes an inner surface 52 that is concentric with respect to the axis X-X and the auger 3. The inner surface 52 is adapted to engage the auger 3. By adjusting the rotational position of the steering sleeve 18*a* within the casing, the circumferential orientation of the outer surface 50 can be adjusted relative to the auger. Circumferential adjustment of the steering sleeve 18*a* (as shown by the 4 different circumferential positions of FIGS. 11A-11D) causes radial movement of the auger 3 relative to the casing 4 which provides steering of the auger boring machine through radial movement of the cutting head 2*a* relative to the casing 4.

When the boring machine 1 is in use it may be used in conjunction with cutting head 2 location means known in the industry for identifying the position of the cutting head 2 within the earth 7. This information can then be relayed to the operators of the auger boring machine 1 to steer the casing 4 back towards the selected direction. Where the cutting head 2 engages a floater or root it can be moved to an extended operating position (FIG. 3) so as to move the root or floater into the flight of the auger 3, rather than having to grind the root or floater into particulate spoil.

Figure 12A:
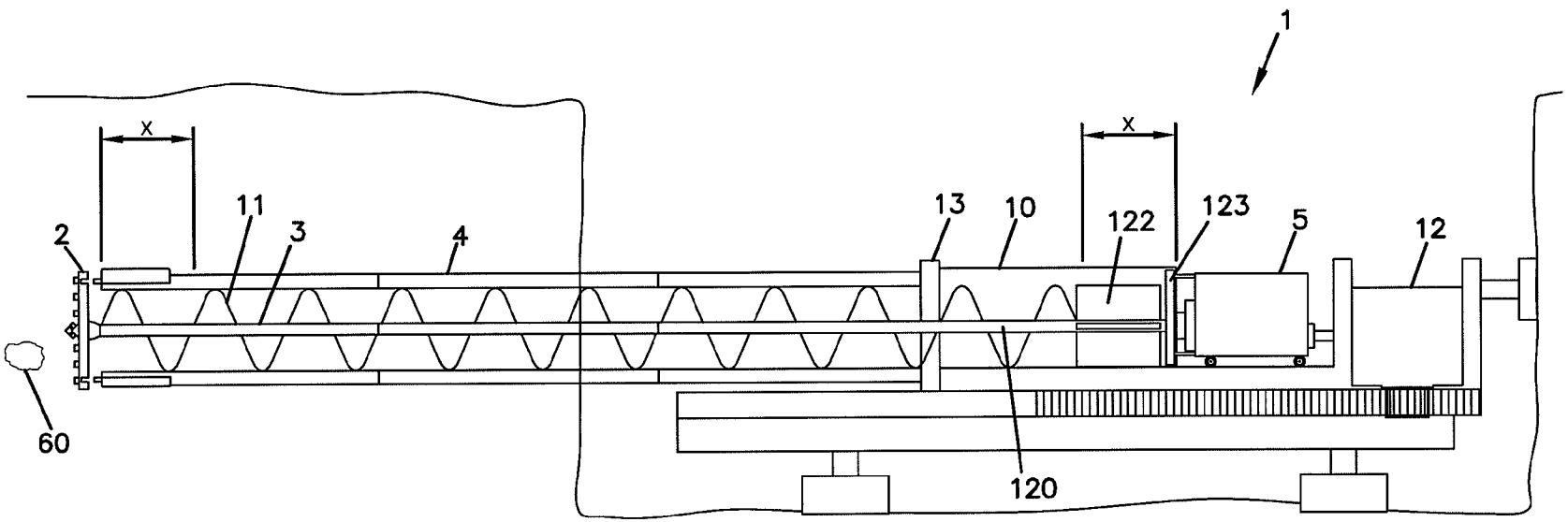
FIG. 12A illustrates the auger boring machine in a normal operating position with the cutting head approaching a floating obstruction.
Figure 12B:
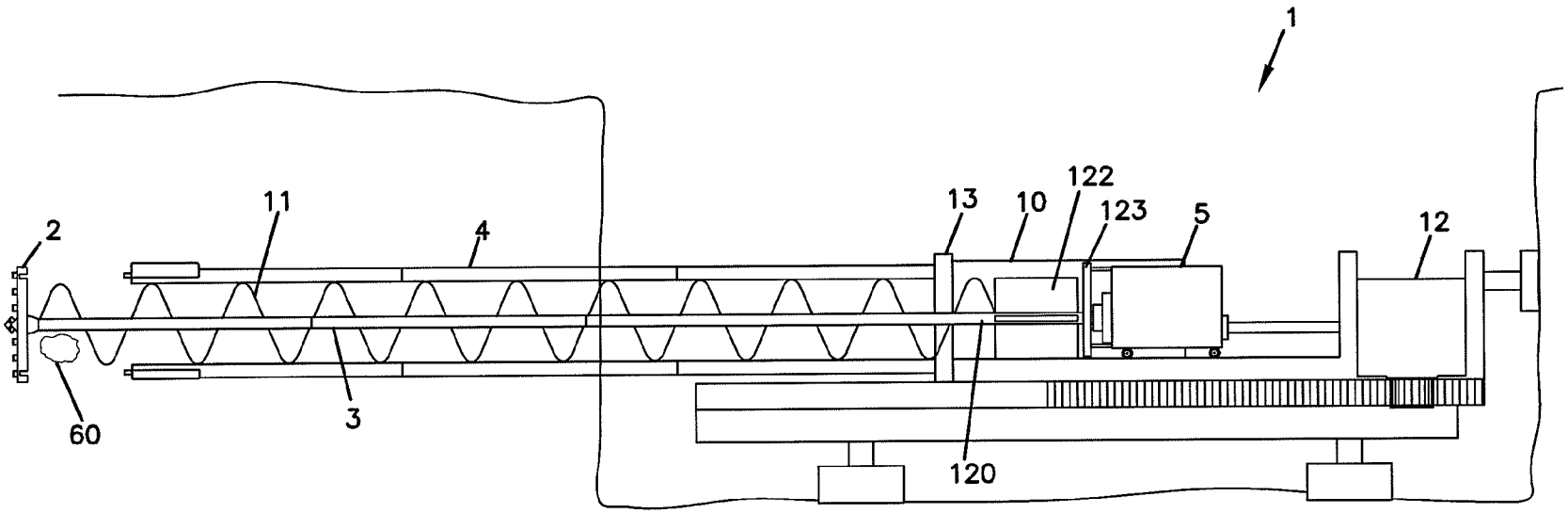
FIG. 12B illustrates the auger boring machine with the cutting head and auger extended to allow the floating obstruction to be manipulated though the cutting head.
Figure 12C:
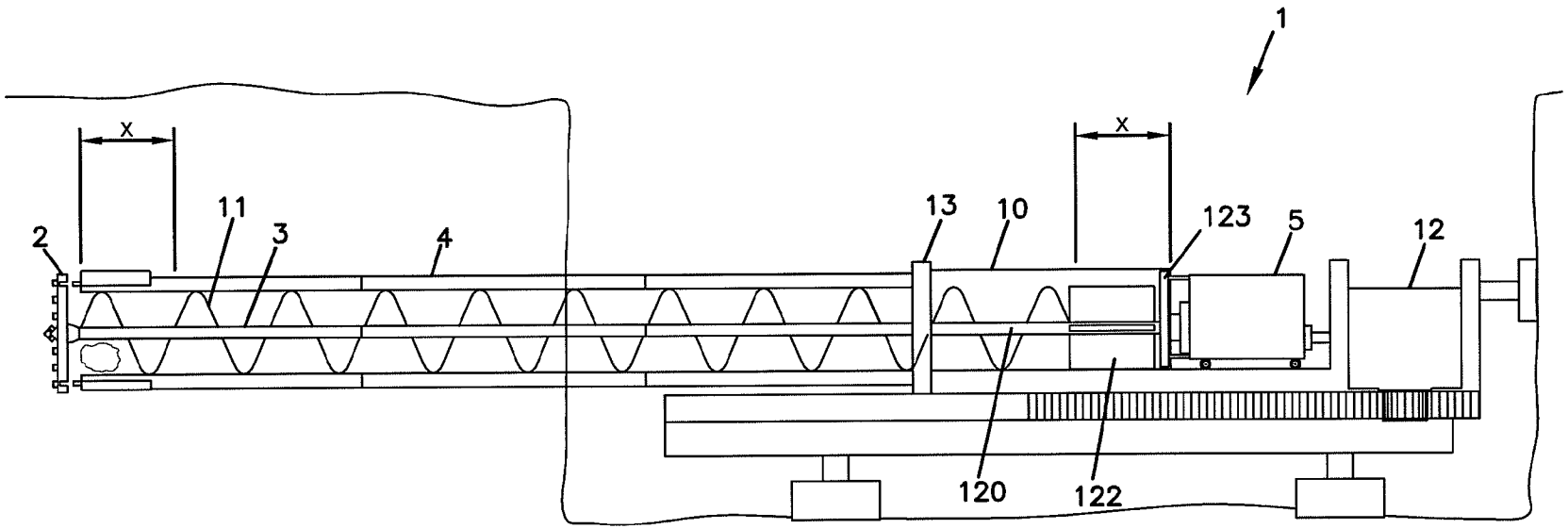
FIG. 12C shows the auger boring machine retracted back to the normal operating position such that the floating obstruction has been retracted back into the casing along with the auger.

FIGS. 12A-12C show how the auger boring machine 1 can be used to manipulate an obstruction 60 through the cutting head 2 and into the casing 4, rather that being required to fully grind the obstruction. FIG. 12 A shows the cutting head 2 approaching the obstruction. Upon impact with the obstruction, the operator can stop rotation of the cutting head 2. Next, the operator can manipulate the rotational position of the cutting head 2 about the axis X-X while concurrently extending the cutting head 2 the distance x from the retracted position to the extended position. As the cutting head is axially advanced (through extension of the auger relative to the casing), the obstruction 60 is manipulated through an open region of the cutting head 2 until the obstruction is located at an intermediate position located proximal of the back side of the cutting head 2 (see FIG. 12B). The obstruction 60 is then moved from the intermediate position into the distal end of the casing 4. For example, the obstruction can be pulled into the casing by retracting the cutting unit 2 such that the back side of the cutting unit 2 contacts the obstruction and pushes the obstruction proximally into the casing. Alternatively, the auger 3 can be rotated such that the obstruction 60 catches in the flights 11 and is pulled into the casing 4. In practice, the obstruction will likely be moved into the casing though a combination of the above described techniques. FIG. 12C shows the obstruction retracted into the casing 4. Once the obstruction is within the casing 4, the auger 3 can be rotated about the drive axis X-X to move the obstruction proximally through the casing.

It will be appreciated that a variety of techniques can be used to manipulate the obstruction through the cutting head as the cutting head is axially advanced relative to the casing. For example, the operator may slowly rotate the cutting head about the drive axis as the cutting head is axially advanced relative to the casing to manipulate the obstruction through the cutting head. For this manipulation technique, the rate of rotation used would be significantly slower than the cutting head is typically rotated about the drive axis during normal drilling operations. Alternatively, the operator may rotationally oscillate the cutting head back and forth about the drive axis as the cutting head is axially advanced relative to the casing to manipulate the obstruction through the cutting head. Alternatively, for certain applications, the operator may not rotate the cutting head at all about the drive axis as the cutting head is axially advanced relative to the casing to manipulate the obstruction through the cutting head. By manipulating the obstruction through the cutting head as described above, the obstruction passed through the cutting head can have a significantly larger size than the size of the reduced material (i.e., the material that has been reduced in size through the cutting action of the cutting head) that is typically passed through or around the cutting head during normal drilling operations with the cutting head rotated at normal drilling speeds. In this way, the floating obstruction can be passed through the cutting head in substantially unreduced form. "Substantially unreduced form" means that the floating obstruction has not been reduced (e.g., broken down, cut, abraded, fractured, sheared, grinded, etc.) by the cutting head to a size suitable for passing through the cutting head under normal drilling conditions with the cutting head rotated at normal drilling speeds.

To facilitate manipulating the obstruction 60 through the cutting head, it is desirable for the cutting head to have an open configuration that allows relatively large pieces of material to pass axially through the cutting head. In one embodiment, the cutting head defines a through opening (e.g., the open region between the bars of cutters 2, 2*a* or 2*b*) having a transverse cross-sectional area (the cross-sectional area when viewed along the axis X-X) equal to at least 15 percent, or at least 20 percent, or at least 30 percent, or at least 40 percent of a transverse cross sectional area of the bore drilled by the cutting head.

Figure 13:
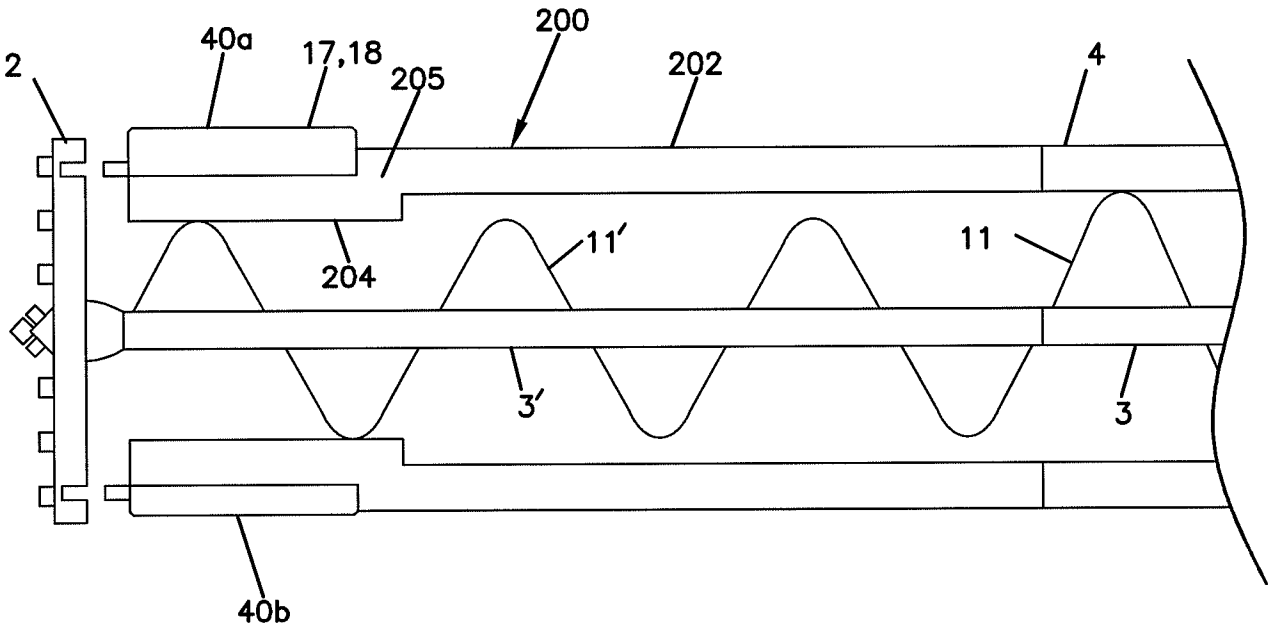
FIG. 13 shows a drill head in accordance with the principles of the present disclosure.

FIG. 13 show a drill head 200 in accordance with the principles of the present disclosure. The drill head 200 includes the same retractable/extendable cutter 2 and steering sleeve 17, 18 (with first and second portions 40*a*, 40*b*) that have been previously described. The drill head 200 is adapted to be connected to the distal end of a string of casings 4 surrounding a string of augers 3. The drill head 200 includes an outer body forming an annular casing including a proximal portion 202 and a distal portion 204. The proximal and distal portions 202, 204 are connected by a radial in-step 205. The radial in-step 205 provides the distal portion 204 with a reduced inner and outer diameter as compared to the proximal portion 204. The radial in-step 205 provides space for mounting a bearing between the outer diameter of the distal portion 204 and the steering sleeve 17, 18. A proximal end of the proximal portion 202 connects to a distal end of the distal most casing 4 of the string of casings.

The drill head 200 also includes an auger section 3' aligned along the axis of rotation of the cutter 2. The auger section 3' has a distal end connected to the cutter 2 and a proximal end that connects to a distal end of the distal-most auger 3 of the string of augers. The auger section 3' includes a flight 11' having a reduced outer diameter as compared to the outer diameter of the flight 11 of the auger 3. The outer diameter of the flight 11' is selected to allow the auger section 3' to be readily extended and retracted through the reduced inner diameter of the distal portion 204 of the outer body of the drill head 200. Similarly, the length of the flight 11' is selected such that at least one flight length of the auger section 3' can be extended distally outwardly beyond the distal-most end of the outer body of the drill head 200.

It ought to be appreciated from the foregoing description that an auger boring machine 1 according to this invention provides a useful alternative to overcoming obstructions in the path of the selected direction of the bore 8. The ability of the machine 1 to steer the casing 4 so as to maintain alignment with the selected direction, is a particularly preferred advantage. In an alternative embodiment, a vacuum source can be provided adjacent the rotational drive means 5 for applying vacuum to the interior of the casing. The vacuum can be used to draw spoils through the casings in a distal to proximal direction. The vacuum can replace the auger or can be used in combination with the auger. Drilling fluid can be provided at the distal end of the drill string to facilitate evacuating the spoils from the bore.

Various alterations and/or additions may be introduced to the auger boring machine without departing from the spirit or ambit of the invention.

What is claimed is:

1. An auger boring machine for boring through earth, the boring machine comprising: a cutting head for engaging a working face of the earth to cut a bore, the cutting head being rotatable about a drive axis so as to cut the earth at the working face; an auger that is rotatable about the drive axis for transporting spoil resulting from the operation of the cutting head away from the cutting head; a casing housing the auger which is urged to move into the bore behind the cutting head, the cutting head and the auger being movable along the drive axis relative to the casing; and a steering member positioned near the cutting head for directing movement of the casing into the bore in a steered direction transverse to the drive axis, wherein the steering member is rotated relative to the casing to different rotational positions about the drive axis for adjusting the steered direction.

2. An auger boring machine according to claim 1 wherein the steering member comprises a sleeve including a portion that is eccentric relative to the drive axis.

3. An auger boring machine according to claim 1 wherein steering member comprises a sleeve including an outer surface, the outer surface including a first portion having a maximum radial offset from the drive axis and a second portion having a radial offset from the drive axis that is less than the maximum radial offset, and wherein a rotational position of the first portion is adjusted about the drive axis to adjust the steering direction.

4. An auger boring machine according to claim 1 wherein the steering member is rotated in conjunction with rotation of the cutting head about the drive axis to adjust the steered direction.

5. An auger boring machine according to claim 4 wherein the cutting head is retracted in the axial direction to engage directly or indirectly the steering member and is rotated about the drive axis to rotate the steering member thereby changing a rotational position of the steering member relative to the drive axis.

6. An auger boring machine according to claim 5 wherein the cutting head is rotatable in a clockwise or an anticlockwise direction to rotate the steering member accordingly.

7. An auger boring machine according to claim 5 wherein the cutting head is configured to positively engage the steering member so that rotation of the cutting head causes direct rotation of the steering member.

8. An auger boring machine according to claim 7 wherein the cutting head and steering member include one or more teeth which interact to positively engage when the cutting head is retracted into engagement with the steering member.

9. An auger boring machine according to claim 1 wherein the cutting head is connected to the auger adjacent a distal end of a distal end portion of the auger, and wherein the auger boring machine further comprises: a rotational driver for rotating the auger and the cutting head relative to the casing; a first axial driver for applying thrust to the casing for axially advancing the casing into the bore, the first axial driver also axially advancing the rotational driver in concert with the axial advancement of the casing; a second axial driver for moving the auger along the drive axis relative to the casing, wherein the second axial driver moves the auger distally along the drive axis to extend the distal end portion of the auger outwardly from a distal-most end of the casing, and wherein the second axial driver moves the auger proximally along the drive axis to retract the distal end portion of the auger back into the distal-most end of casing.

10. An auger boring machine according to claim 9 wherein the second axial driver is capable of moving the cutting head and the auger an extension distance relative to the casing, the extension distance extending along the drive axis and being equal to at least one auger flight length.

11. An auger boring machine according to claim 9 wherein the second axial driver is capable of moving the cutting head and the auger an extension distance relative to the casing, the extension distance extending along the drive axis and being equal to at least three-quarters of one auger flight length.

12. An auger boring machine according to claim 9 wherein the first axial driver drives a thrust frame, wherein the rotational driver is mounted on the thrust frame, and wherein the second axial driver is capable of moving the rotational driver, distally and proximally relative to the thrust frame.

13. An auger boring machine according to claim 1 wherein the cutting head is connected to the auger adjacent a distal end of a distal end portion of the auger, and wherein the auger boring machine further comprises an axial driver for moving the auger along the drive axis relative to the casing, the axial driver moving the auger distally along the drive axis to extend the distal end portion of the auger outwardly from a distal-most end of the casing, and the axial driver moving the auger proximally along the drive axis to retract the distal end portion of the auger back into the distal-most end of casing.

14. An auger boring machine according to claim 13 wherein the axial driver is capable of moving the cutting head and the auger an extension distance relative to the casing, the extension distance extending along the drive axis and being equal to at least one auger flight length.

15. An auger boring machine according to claim 13 wherein the axial driver is capable of moving the cutting head and the auger an extension distance relative to the casing, the extension distance extending along the drive axis and being equal to at least three-quarters of one auger flight length.

16. An auger boring machine for boring through earth, the boring machine having a distal end and a proximal end, the boring machine comprising: a cutting head for engaging a working face of the earth to cut a bore, the cutting head being positioned at the distal end of the auger boring machine, the cutting head being rotatable about a drive axis so as to cut the earth at the working face; an auger that is rotatable about the drive axis for transporting spoil resulting from the operation of the cutting head proximally away from the cutting head, the auger being coupled to the cutting head such that rotation of the auger causes rotation of the cutting head, the cutting head being coupled to the auger adjacent a distal end of a distal end portion of the auger; a casing in which the auger is housed; an axial driver positioned adjacent the proximal end of the auger boring machine for moving the auger along the drive axis relative to the casing, the axial driver moving the auger distally along the drive axis to extend the distal end portion of the auger outwardly from a distal-most end of the casing, and the axial driver moving the auger proximally along the drive axis to retract the distal end portion of the auger back into the distal-most end of casing, the axial driver being capable of moving the auger an extension distance relative to the casing, the extension distance extending along the drive axis and being equal to at least three-quarters of one auger flight length.

17. An auger boring machine according to claim 16 wherein the extension distance is equal to at least one auger flight length.

18. An auger boring machine according to claim 16 further comprising a rotational driver for rotating the auger, a thrust frame that carries the rotational driver, and a thrust driver for driving the thrust frame to cause the thrust frame to axially advance the casing into the bore, wherein the axial driver is configured to move the rotational driver the extension distance relative to the thrust frame.

19. An auger boring machine according to claim 18 further comprising a steering member positioned near the cutting head for directing movement of the casing into the bore in a steered direction transverse to the drive axis.

20. An auger boring machine according to claim 19 wherein the steering member is rotated relative to the casing to different rotational positions about the drive axis for adjusting the steered direction, and wherein the steering member is rotated in conjunction with rotation of the cutting head about the drive axis to adjust the steered direction.

21. A method for operating an auger boring machine, the auger boring machine including an auger rotatably positioned within a casing, the auger boring machine also including a cutting head connected to the auger adjacent a distal end of a distal end portion of the auger such that rotation of the auger about a drive axis causes rotation of the cutting head about the drive axis, the auger being configured to move spoil generated by the cutting head through the casing in a distal to proximal direction, the method comprising: drilling a bore with the auger boring machine; encountering a floating obstruction located distally with respect to the cutting head; moving the cutting head and the distal end portion of the auger distally outwardly from a distal-most end of the casing; passing the floating obstruction through cutting head in substantially unreduced form as the cutting head and the distal end portion of the auger are moved distally outwardly from the distal-most end of the casing, wherein after the floating obstruction has passed though the cutting head the floating obstruction is located at an intermediate position that is proximal with respect to the cutting head; moving the floating obstruction from the intermediate position into the casing; and conveying the floating obstruction though the casing in a distal to proximal direction by rotating the auger about the drive axis.

22. A method according to claim 21, wherein the floating obstruction is moved from the intermediate position into the casing by rotating the auger about the drive axis.

23. A method according to claim 21, wherein the floating obstruction is moved from the intermediate position into the casing by moving the distal end portion of the auger and the cutting head proximally relative to the casing such that the distal end portion of the auger is retracted back into the casing.

24. A method for operating a boring machine, the boring machine including a drive shaft rotatably positioned within a casing, the boring machine also including a cutting head connected to the shaft adjacent a distal end of the shaft such that rotation of the shaft about a drive axis causes rotation of the cutting head about the drive axis, the method comprising: drilling a bore with the boring machine; encountering a floating obstruction located distally with respect to the cutting head; moving the cutting head and a distal end portion of the shaft distally outwardly from a distal-most end of the casing; passing the floating obstruction through cutting head in substantially unreduced form as the cutting head and the distal end portion of the shaft are moved distally outwardly from the distal-most end of the casing, wherein after the floating obstruction has passed though the cutting head the floating obstruction is located at an intermediate position that is proximal with respect to the cutting head; moving the floating obstruction from the intermediate position into the casing; and conveying the floating obstruction though the casing in a distal to proximal direction.

25. An auger boring machine for boring through earth, the boring machine comprising: a cutting head for engaging a working face of the earth to cut a bore, the cutting head being rotatable about a drive axis so as to cut the earth at the working face; an auger that is rotatable about the drive axis for transporting spoil resulting from the operation of the cutting head away from the cutting head; a casing housing the auger which is urged to move into the bore behind the cutting head, the cutting head and the auger being movable along the drive axis relative to the casing; and a steering member positioned near the cutting head for directing movement of the casing into the bore in a steered direction transverse to the drive axis, wherein the cutting head is connected to the auger adjacent a distal end of a distal end portion of the auger, and wherein the auger boring machine further comprises: a rotational driver for rotating the auger and the cutting head relative to the casing; a first axial driver for applying thrust to the casing for axially advancing the casing into the bore, the first axial driver also axially advancing the rotational driver in concert with the axial advancement of the casing; a second axial driver for moving the auger along the drive axis relative to the casing, wherein the second axial driver moves the auger distally along the drive axis to extend the distal end portion of the auger outwardly from a distal-most end of the casing, and wherein the second axial driver is capable of moving the cutting head and the auger an extension distance relative to the casing, the extension distance extending along the drive axis and being equal to at least three-quarters of one auger flight length, and wherein the second axial driver moves the auger proximally along the drive axis to retract the distal end portion of the auger back into the distal-most end of casing.

26. An auger boring machine according to claim 25 wherein the extension distance is equal to at least one auger flight length.

27. An auger boring machine for boring through earth, the boring machine comprising: a cutting head for engaging a working face of the earth to cut a bore, the cutting head being rotatable about a drive axis so as to cut the earth at the working face; an auger that is rotatable about the drive axis for transporting spoil resulting from the operation of the cutting head away from the cutting head; a casing housing the auger which is urged to move into the bore behind the cutting head, the cutting head and the auger being movable along the drive axis relative to the casing; and a steering member positioned near the cutting head for directing movement of the casing into the bore in a steered direction transverse to the drive axis, wherein the cutting head is connected to the auger adjacent a distal end of a distal end portion of the auger, and wherein the auger boring machine further comprises an axial driver for moving the auger along the drive axis relative to the casing, the axial driver moving the auger distally along the drive axis to extend the distal end portion of the auger outwardly from a distal-most end of the casing, and the axial driver moving the auger proximally along the drive axis to retract the distal end portion of the auger back into the distal-most end of casing, wherein the axial driver is capable of moving the cutting head and the auger an extension distance relative to the casing, the extension distance extending along the drive axis and being equal to at least three-quarters of one auger flight length.

28. An auger boring machine according to claim 27 wherein the extension distance is equal to at least one auger flight length.

* * * * *